United States Patent [19]

Lin

[11] Patent Number: 5,010,752

[45] Date of Patent: Apr. 30, 1991

[54] STRUCTURE FOR CONTROLLING THE DEAD BOLT IN AN ELECTRONIC LOCK

[75] Inventor: Ruey J. Lin, KangShan, Taiwan

[73] Assignee: Taiwan Fu Hsing Industry Co., Ltd., KangShan, Taiwan

[21] Appl. No.: 469,017

[22] Filed: Jan. 23, 1990

[51] Int. Cl.[5] ..... E05B 47/00

[52] U.S. Cl. ..... 70/277; 70/278; 70/472

[58] Field of Search ..... 70/277, 278, 279, 472, 70/224; 340/825.31, 825.3; 307/10 AT; 235/382.5

[56] References Cited

U.S. PATENT DOCUMENTS

| | | | |
|---|---|---|---|
| 1,834,223 | 12/1931 | Rymer | 70/472 |
| 2,662,387 | 12/1953 | Hagstrom | 70/472 |
| 3,512,381 | 5/1972 | Matsunaga | 70/472 |
| 4,429,556 | 2/1984 | Kambie | 70/472 |
| 4,672,829 | 6/1987 | Gater | 70/472 |
| 4,820,330 | 4/1989 | Lin | 70/273 |

*Primary Examiner*—Robert L. Wolfe

*Attorney, Agent, or Firm*—Fleit, Jacobson, Cohn, Price, Holman & Stern

[57] ABSTRACT

A structure for controlling the dead bolt in an electronic lock, wherein rotation of a turning button set on the inside knob can make a clutch engage with or separated from a turning disc so that rotation of the outside knob either can pull in the dead bolt or can only move idly.

7 Claims, 6 Drawing Sheets

STRUCTURE FOR CONTROLLING THE DEAD BOLT IN AN ELECTRONIC LOCK

BACKGROUND OF THE INVENTION

This invention has the object to improve the U.S. Pat. titled the same of Ser. No. 4,820,330 as this invention simplifying the controlling structure so as to be widely used for common homes.

SUMMARY OF THE INVENTION

This invention comprises a control case containing an electronic circuit for decoding a coded card to be inserted to open this lock, and an outside knob to rotate an outer square shaft which can rotate a moving rod at the same time, said moving rod linked with a turning disc possible to engage with or separate from a clutch. When the turning disc is engaging with the clutch, the outside knob can be rotated to make an inner tube to pull in the dead bolt via the clutch.

This invention also comprises an inside knob linked and rotating with the inner tube which can rotate an inner square tube passing through the moving plate of the dead bolt to pull in the dead bolt when rotated.

BRIEF DESCRIPTION OF THE DRAWINGS

This invention will now be described in detail with reference to accompanying drawings wherein.

DETAILED DESCRIPTION OF THE INVENTION

Figure 1:
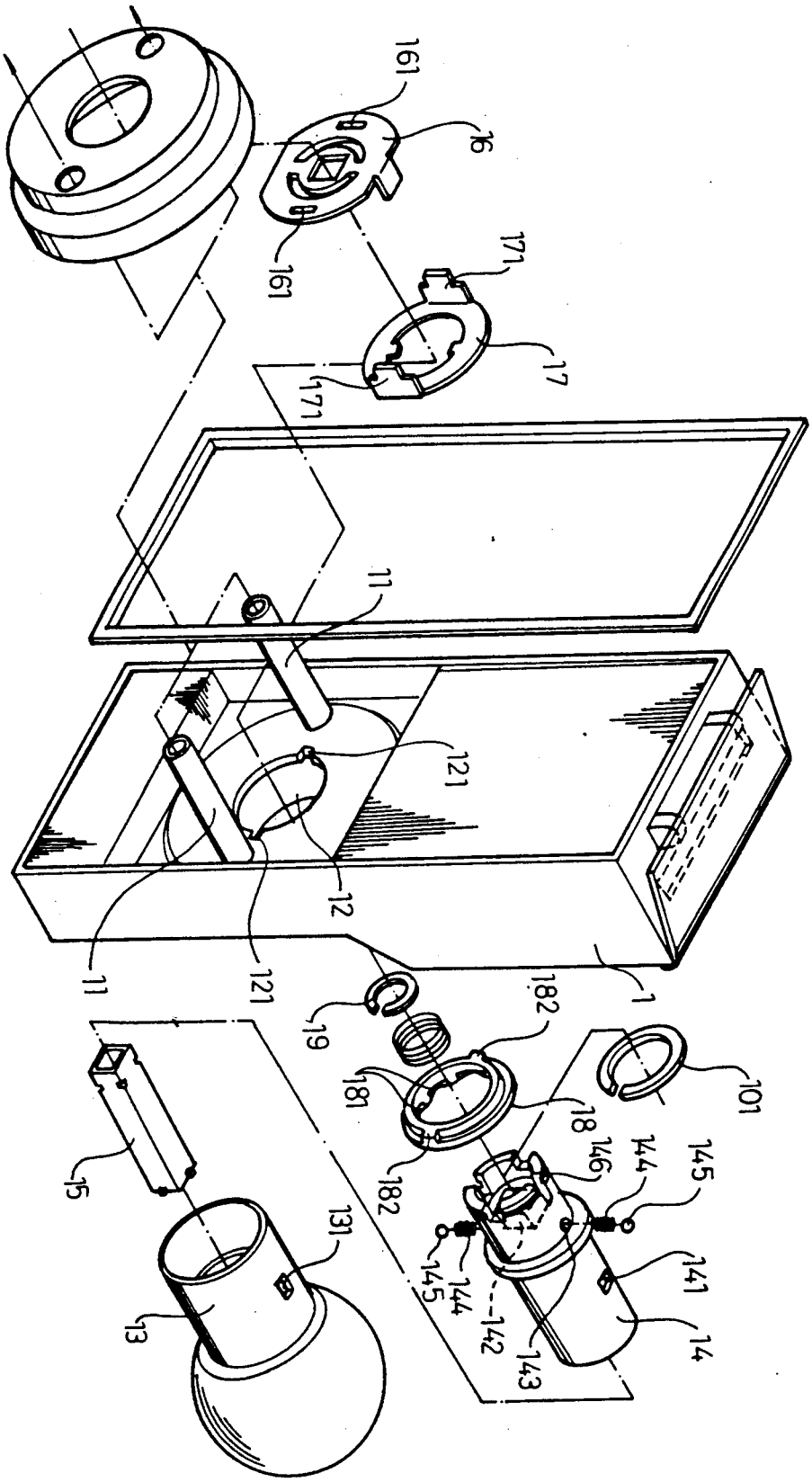
FIG. 1 is an exploded perspective view of the outside section of the first embodiment in the present invention.

Referring to FIG. 1, the outside section of the first embodiment of the lock according to the present invention comprises control case 1 for containing an electronic circuit for reading a coded card to open this lock and control case 1 has two feet 11 for fixing securely said case 1 on the outside surface of a door. Control case 1 is provided with shaft hole 12 for outside knob 13 to pass through and rotate therein, and said knob 13 has recess 131 engaging in hole 141 in inner cylinder 14 for mutual rotation of the both 13 and 14. Inner cylinder 14 is provided with square hole 142 for a square shaft 15 to run through and to be caught by C-shaped ring 19 to prevent shaft 15 from hiding completely inside cylinder 14. Shaft 15 can rotate along with outside knob 13 when said knob is rotated, and runs through return plate 16 having two curved slots stuck in cylinder 14, then C-shaped ring 101 is stuck in ring groove 146 in cylinder 14 such that return plate 16 may not fall off its position. Return plate 16 is provided with two opposite vertical slots 161 for two feet 171 of limit plate 17 to stick through so that limit plate 17 rotates along with return plate 16. In order to keep outside knob 13 in the accurate definite position, two opposite holes 143 are provided in cylinder 14 to contain spring 144 and steel ball 145 respectively, and ball 145 urged by spring 144 pushes against the inner peripheral edge of position ring 18 having a plurality of petal-shaped curved grooves 181 equally spaced apart on the inner peripheral edge and two opposite projections 182 to engage in two notches 121 of shaft hole 12. Therefore, though said knob 13 can be rotated for 360° in clockwise or counter-clockwise direction, said knob 13 has a start and a terminal point in rotation in relation to position ring 18. Its function will be described later.

Figure 2:
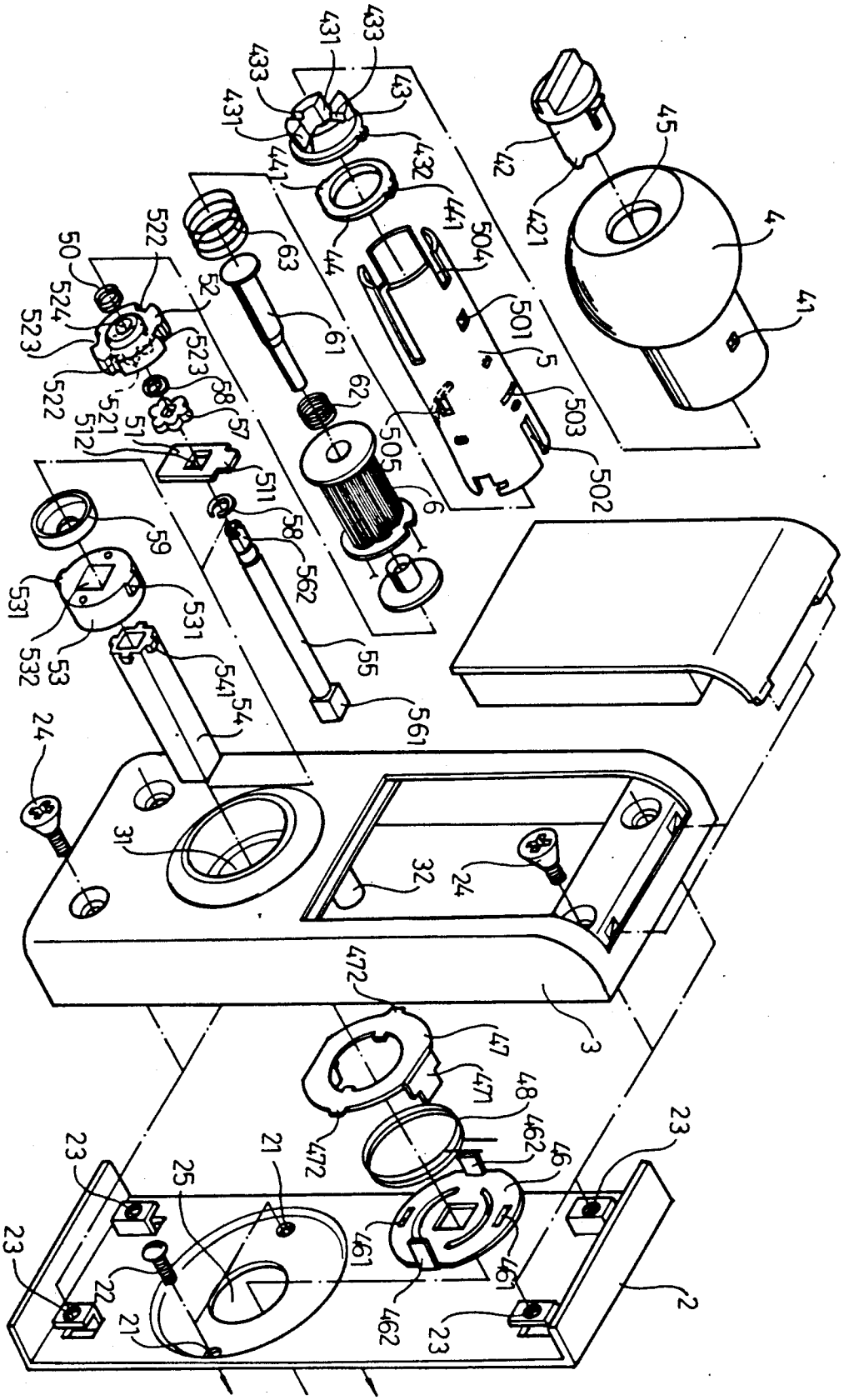
FIG. 2 is an exploded perspective view of the inside section of the first embodiment in the present invention.

Next, referring to FIG. 2, the inside section of the lock comprises bottom plate 2 provided with two holes 21 for bolts 22 to run through to screw with feet 11 of control case 1, four threaded holes 23 for bolts 24 to combine inner case 3 with bottom plate 2, and shaft hole 25 for the shaft of inner knob 4 to pass through and rotate therein and in shaft hole 31 in inner case 3.

Inner knob 4 is combined in its inner surface with inner tube 5 and provided with recess 41 engaging with recess 501 of inner tube 5 for mutual rotation, shaft hole 45 for turning button 42 to insert and rotate therein. Turning button 42 has tapered surface 421 at the inner end to engage with tapered grooves 431 of disc 43, which has two opposite projections 432 to stick in slot 504 in inner tube 5 together with two projections 441 provided in gasket 44. So disc 43 can be moved straight along slot 504 because of mutual engagement of tapered surface 421 and tapered grooves 431, when turning button 42 is rotated.

Inner tube 5 is provided with slot 502 for projection 531 of moving ring 53 to stick in so as to allow moving ring 53 to rotate in said tube 5 together with inner knob 4. Moving ring 53 is provided with square shaft hole 532 for square shaft 54 to fit in, and shaft 54 has projections 541 to keep shaft 45 always fitted in said hole 532 without falling off and linked with the dead bolt not drawn in the drawings. Rotation of shaft 54 can extend out or pull in the dead bolt. Moving rod 56 is contained in the inner hole of square shaft 54 and turns idly therein without mutual movement. Moving rod 56 is longer than square shaft 54 and has square end 561 extending out of shaft 54 to fit in the inner hole of square shaft 15 in the outside section of this lock such that moving rod 56 can be rotated together with square shaft 15 when said shaft 15 is rotated, but square shaft 54 is not owing to idle rotation of moving rod 56 therein. Moving rod 56 has another oval end 562 to engage with petal-shaped turning disc 57 combined securely with moving rod 56 by C-shaped ring 58 and gasket 59. Now, also referring to FIG. 4, position plate 51 is placed between turning disc 57 and gasket 59, provided with projection 511 to stick in slot 503 in inner tube 5 for keeping moving rod 56 in its position in the lock and allowing said rod 56 to rotate idly in hole 512 in said plate 51 unmovable in the axis direction.

Turning disc 57 has a plurality of petals, and is contained in clutch groove 521 in clutch 52. The number of the petals is the same as that of curved grooves 181 of position ring 18 and both of them have the same curve such that the rotation of outside knob 13 in relation to position ring 18 may have accurate start and terminal points when turning disc 51 is engaging with clutch 52, which can move together with inner tube 5, and has two opposite guide notches 522 engaging with recesses 505 of inner tube 5 to move straight enabling itself to engage with or separate rate from turning disc 57. Besides, clutch 52 has two opposite notches 523 for wire to pass through, central hole 524 for a rivet to fix clutch 52 on shaft 61 of electro-magnetic coil 6 mounted securely in inner tube 5. Shaft 61 can be sucked by said coil 6 to move clutch 52 toward turning disc 57 for mutual engagement when said coil 6 is electrified. But shaft 61 is to be separated from turning disc 57 owing to shaft 61 recovering its position resiliently pushed by spring 62.

Shaft 61 has another end in contact with disc 43, which pushes shaft 61 making clutch 52 engage with turning disc 57 when rotation of turning button 42 activates tapered surface 421 to slide up to reach shallow grooves 433 of disc 43. If turning button 42 is further rotated to make tapered surface 421 stick in tapered groove 431, clutch 52 can be separated from turning disc 57 because of shaft 61 resiliently pushed by spring 62 and disc 43 pushed by spring 63 retreating to contact with turning button 42.

In order to return inside knob 4 to its normal position, return plate 46 is set inside inner tube 5, provided with two opposite slots 461 for feet 471 of limit plate 47 to stick in, two opposite feet 462 to rest on the surface of limit plate 47 so as to keep mutual movement and a definite distance between. Besides, spring 48 is set between the both 46 and 47, having one foot stick in foot 32 of inner case 3 and another foot stick at both ends of projection 471 of limit plate 47. Limit plate 47 has two opposite projections 472. So, rotation of inner knob 4 moves one foot of spring 48, and when the rotation force to inner knob 4 disappears, inner knob 4 recovers its normal position resiliently pushed by spring 48, which is the known structure in a lock.

Figure 3:
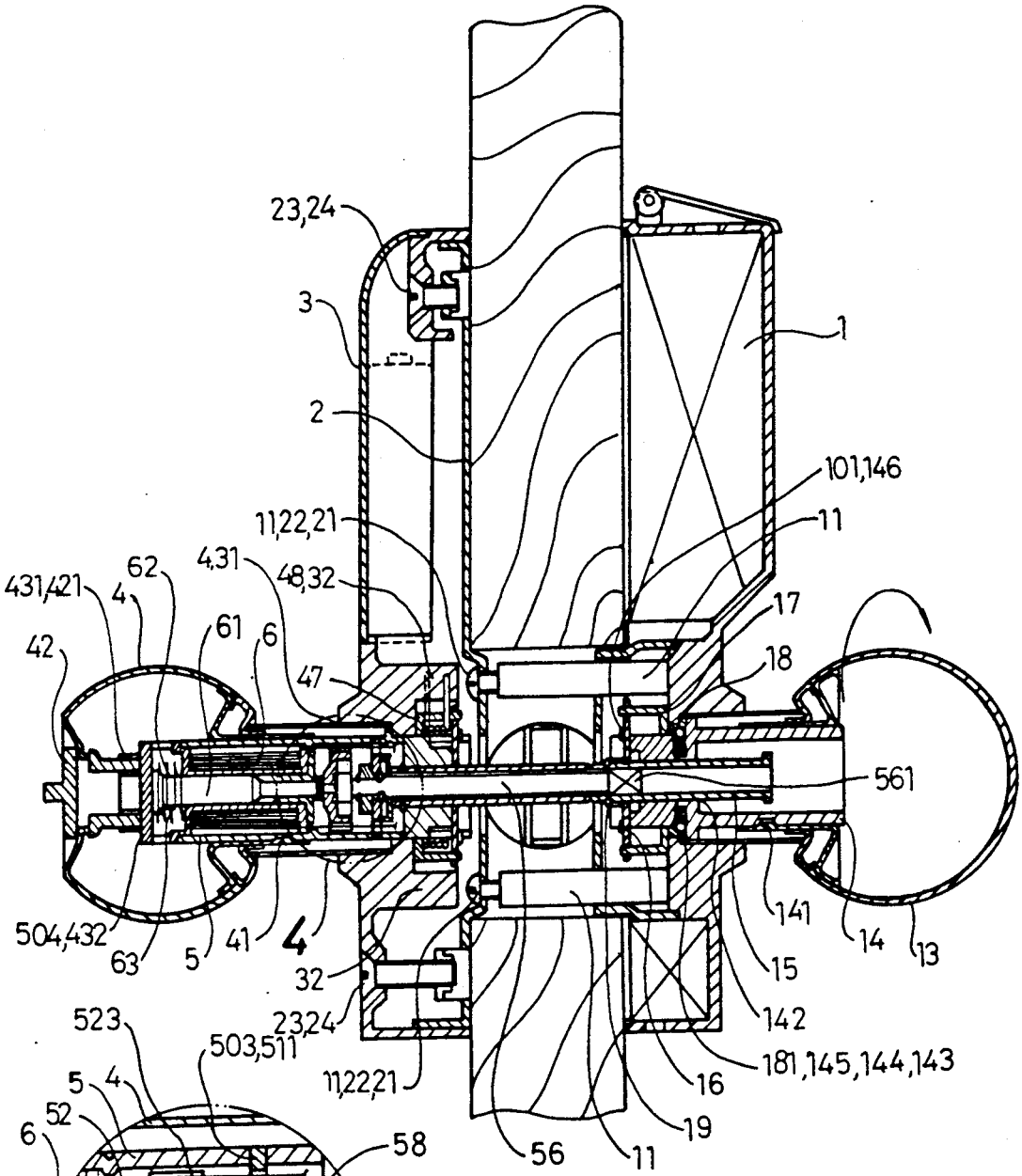
FIG. 3 is a cross-sectional view of this invention with the outside section impossible to open.
Figure 4:
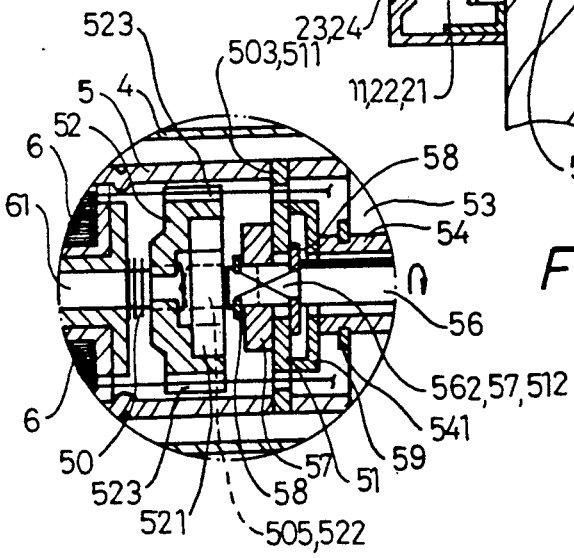
FIG. 4 is an enlarged view of the portion marked 4 in FIG. 3.

FIGS. 3 and 4 show this lock closed, wherein turning button 42 is rotated, tapered surface 421 engaged with tapered groove 431, and clutch 52 separated from turning disc 57. Under this condition, 1. if outside knob 13 is rotated, it can rotate square shaft 15, which then rotates turning disc 57, but turning disc 57 is not engaging with clutch 52. Therefore, rotation of outside knob 13 is idle, unable to pull in the dead bolt;
2. if inside knob 4 is rotated, it can rotate inner tube 5, which then moves square shaft 54 via moving ring 53, and square shaft 54 can pull in the dead bolt, penetrating the moving plate of the dead bolt;
3. if the correct coded card is pushed in control case 1 of the outside lock, electro-magnetic coil 6 is to be electrified for a pre-set period of time to produce magnetic sucking power, by which clutch 52 engages with turning disc 57. Then rotation of outside knob 13 can pull in the dead bolt to open the door during that pre-set period of time, causing orderly rotation of clutch 52, inner tube 5, moving ring 53 and square shaft 54. But when the power to said coil 6 is cut off, outside knob 13 can only rotate idly because of separation of clutch 52 from turning disc 57.

Figures 5, 6:
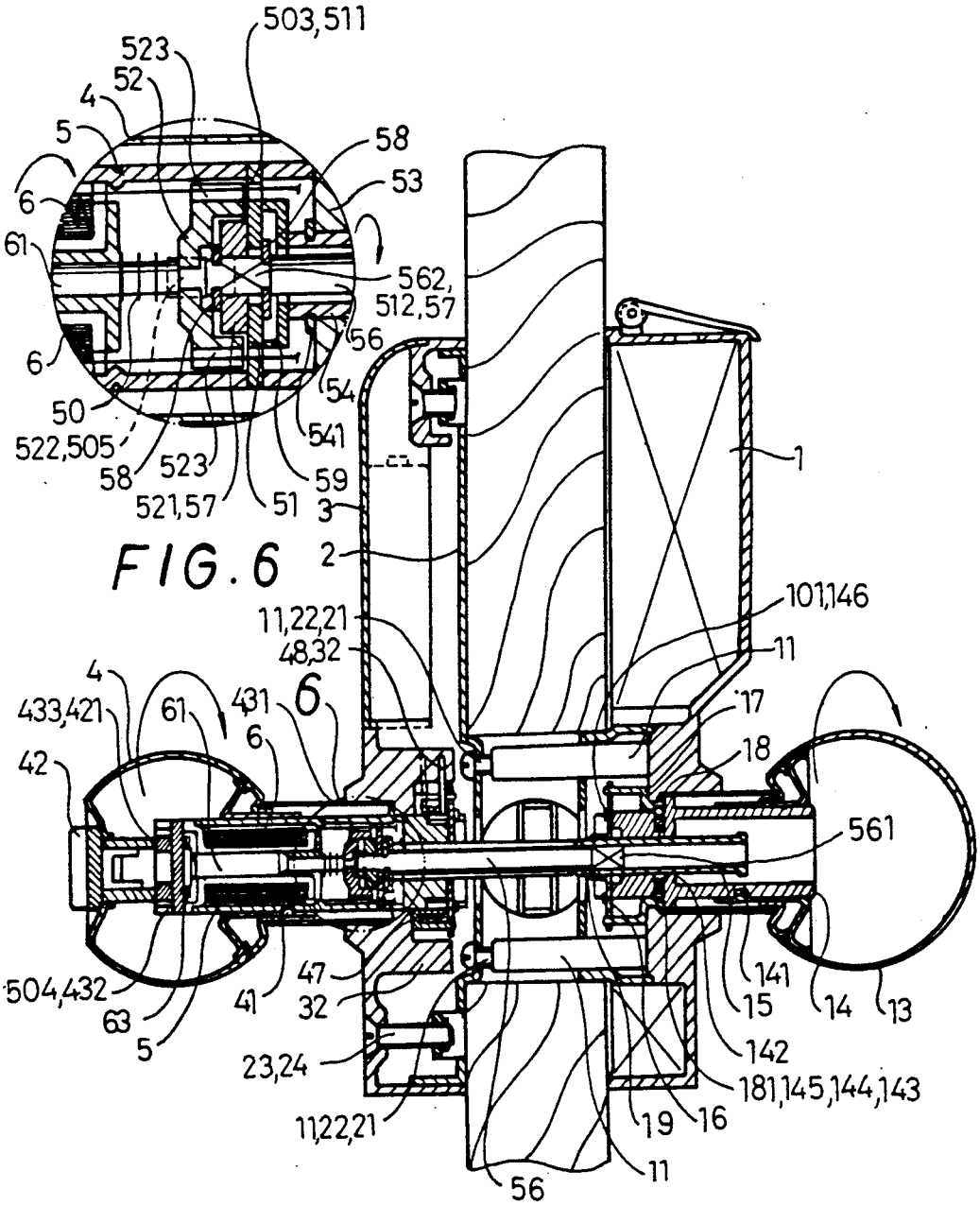
FIG. 5 is a cross-sectional view of this invention with the outside section possible to open.
FIG. 6 is an enlarged view of the portion marked 6 in FIG. 5.

As shown in FIGS. 5 and 6, if turning button 42 is rotated for 90° making the bottom of tapered surface 421 push shallow groove 433, disc 43 pushes central rod 61 and clutch 52 is moved to engage with turning disc 57 urged by spring 50. Then rotation of outside knob 13 can pull in the dead bolt. Under this condition, the door is unlocked.

Figure 7:
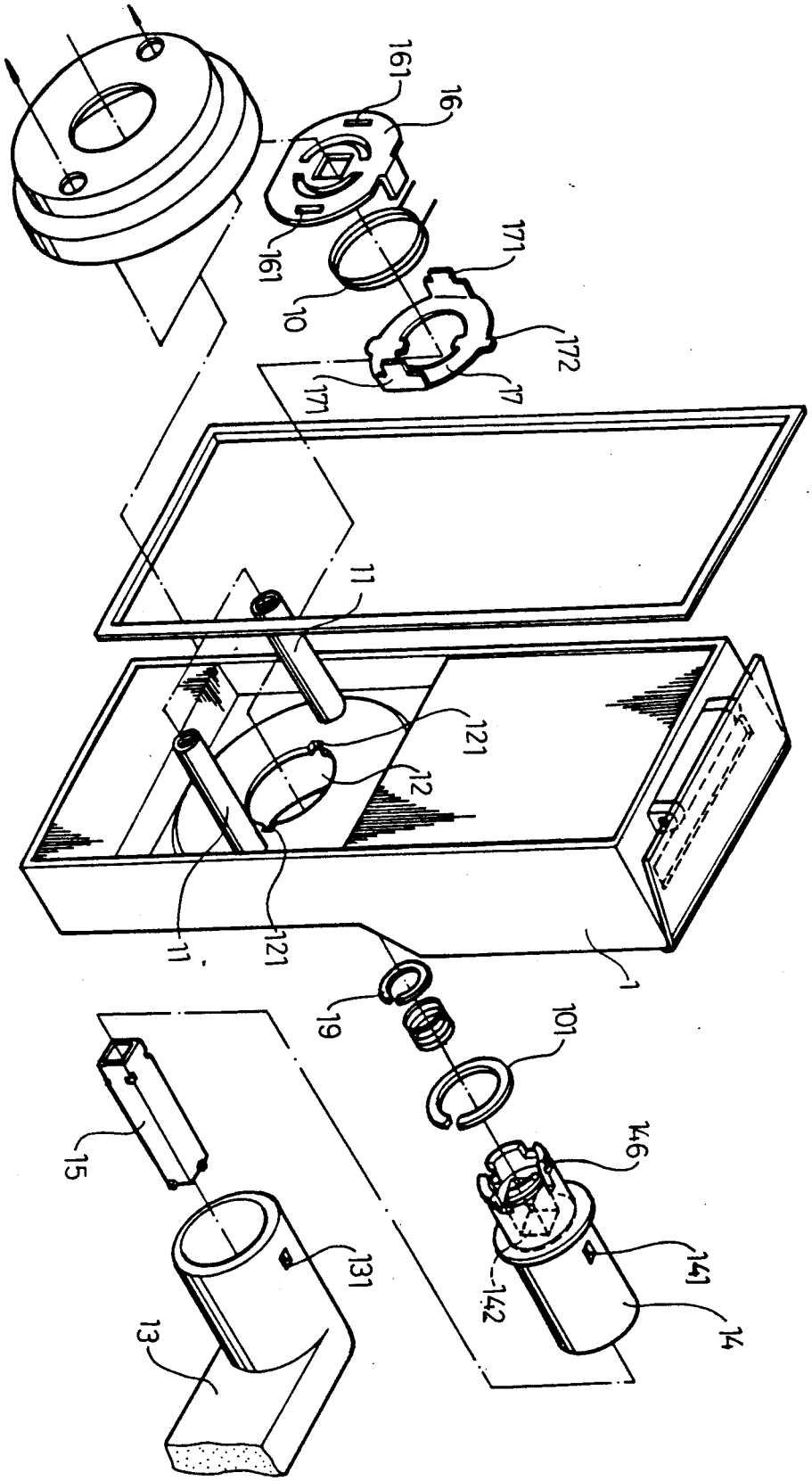
FIG. 7 is an exploded perspective view of the outside section of the second embodiment in the present invention.
Figure 8:
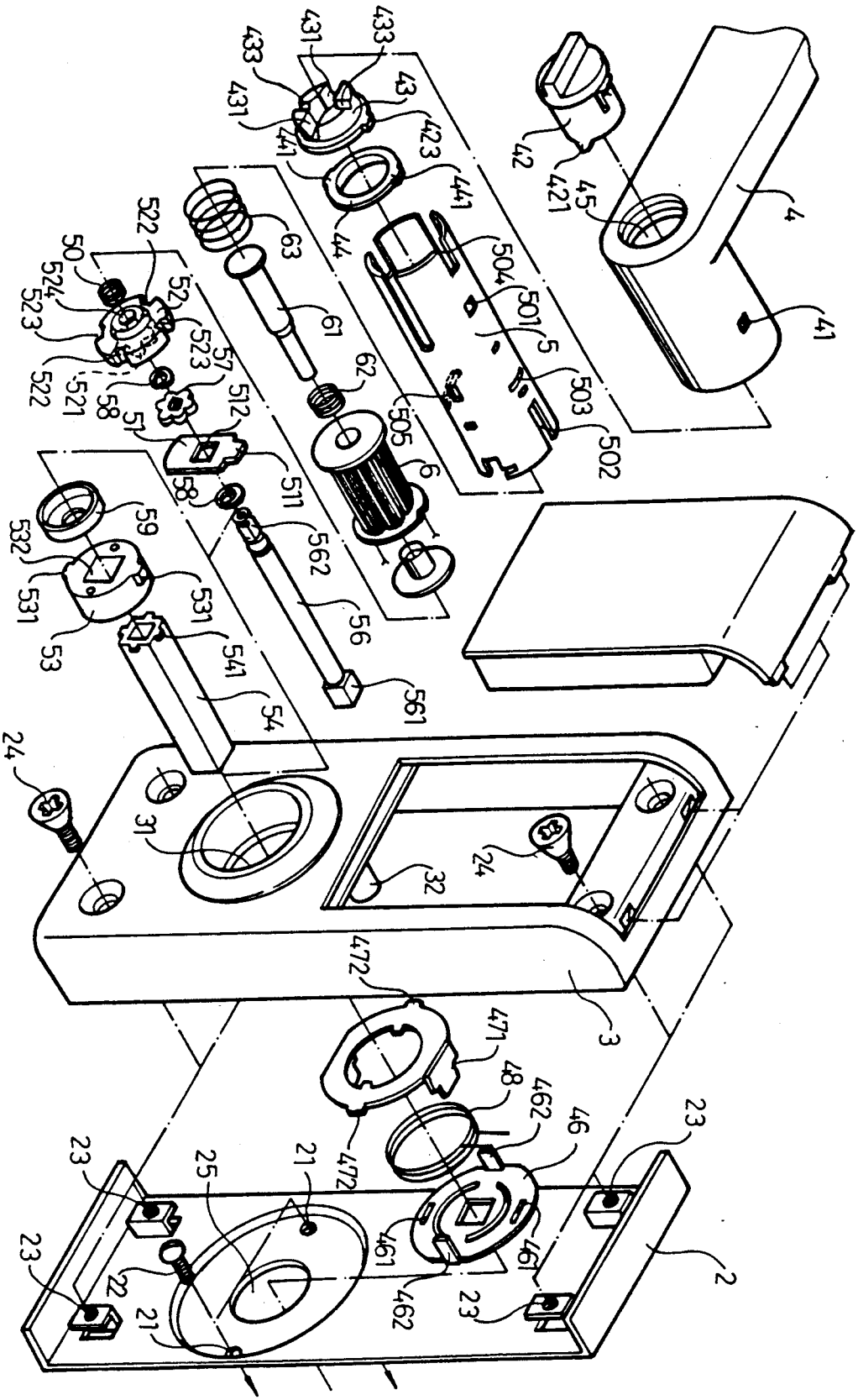
FIG. 8 is an exploded perspective view of the inside section of the second embodiment in the present invention.

Next, as shown in FIGS. 7 and 8, outside handle 13 and inside handle 4 are used instead of knobs, and they can only rotate for 80° clockwise or counterclockwise customarily. So outside handle 13 need not rotate for 360°. Spring 10 is additionally provided between return plate 16 and limit plate 17 also additionally having two opposite projections 172 such that outside handle 13 can only be rotated to the position where said projections 172 are stopped by foot 17, and rotating force to handle 13 disappears, it will automatically return to its normal position. As inside handle 4 and outside handle 13 can return to the start point after released, position ring 18, spring 144 and balls 145 in the first embodiment are unnecessary.

In short, provision of turning button 42 with inside knob 4 can control outside knob 13 to rotate idly or pull in the dead bolt, which is quite a simple and practical structure.

What is claimed is:

1. A structure for controlling a dead bolt in an electro-magnetic lock comprising:

a control case fixed at the outer side of a door for a coded card to insert in and provided with a shaft hole for a shaft of an outside knob to run through and to rotate therein, said outside knob rotating an inner tube having a square hole for an outside square shaft to fit therein so that the rotation of the outside knob can also rotate the outside square shaft;

a bottom plate combined with an inner case fixed at the inside of the door, said bottom plate and inner case having respectively a corresponding shaft hole for a shaft of an inner knob to fit and rotate therein together, said inner knob combined with an inner tube in its inner hole to rotate together, said inner tube having two opposite slots at an outer end thereof for two opposite projections of a moving ring to engage with, said moving ring having a square shaft hole for an inner square shaft fixed in the moving plate of the dead bolt to fit in, said inner square moving plate of the dead bolt to fit in, said inner square shaft having an inner through hole for a moving rod to pass through to rotate therein idly, said moving rod being longer than the inner square shaft and having both ends extending out of the inner square shaft, one end of said moving rod being square and fitting in the outer square shaft for mutual movement therewith, another end of said moving rod being oval and fixed with a peripherally toothed turning disc confined by a limit plate so as to rotate the limit plate but not to move it lengthwise, said limit plate having a projection to stick in a hole in the inner tube; and an electro-magnetic coil contained inside the inner tube for producing magnetism to pull a central rod running through the electro-magnetic coil, one end of said central rod linked with a clutch, said clutch provided with a plurality of grooves for engaging with teeth of the turning disc, another end of said central rod being urged by a spring into contact with a disc, said disc provided with tapered grooves for tapered protrusions on a turning button to selectably contact with, said turning button set in the shaft hole of the inside knob and able to be rotated to move the disc so as to push the central rod to make the clutch engage with the turning disc.

2. The structure for controlling the dead bolt in an electronic lock as claimed in claim 1, wherein rotation of the inside knob can rotate the inner square shaft via the inner tube and moving ring, and the inner square shaft fixed through the moving plate of the dead bolt can pull in the dead bolt.

3. The structure for controlling the dead bolt in an electronic lock as claimed in claim 1, wherein the inner tube combined with the inside knob is provided with two inward recesses to engage in two guide notches in the clutch so that the clutch may move lengthwise in relation to the inner tube.

4. The structure for controlling the dead bolt in an electronic lock as claimed in claim 1, wherein the clutch is provided at one end of the central rod, to be moved lengthwise to engage with the turning disc combined with the end of the moving rod, either by the central rod pulled by the temporary magnetism of the electro-magnetic coil when powered or by rotation of the turning button, or to separate from the turning disc either by the unpowered electro-magnetic coil or by recovering of the turning button to its normal position.

5. The structure for controlling the dead bolt in an electronic lock as claimed in claim 1, wherein one end of the moving rod is square to fit in the inner hole of the outer square shaft for mutual movement, and another end thereof is linked with the turning disc such that rotation of the outside knob can turn the turning disc via the moving rod.

6. The structure for controlling the dead bolt in an electronic lock as claimed in claim 1, wherein the disc is confined to move straight by projections thereon fitting in slots of the inner tube, and rotation of the turning button can either push the disc farther away with the tapered projections climbing up the tapered grooves or let the disc come nearer with the tapered projections sliding in the tapered grooves.

7. The structure for controlling the dead bolt in an electronic lock as claimed in claim 1, wherein the shaft hole in the outside control case has two opposite projecting notches for two opposite projections of the position ring to engage therein, said position ring is provided with the same number of grooves as that of the teeth of the turning disc on its inner peripheral edge, the cylinder of the outside knob is provided with two opposite holes for fitting two springs and two steel balls therein so that the steel balls may urge the grooves of the position ring, and when the outside knob is rotated the turning disc linked with the moving rod always returns to its normal position to engage with the clutch.

* * * * *